United States Patent [19]

Hisada

[11] 3,990,887

[45] Nov. 9, 1976

[54] COLD WORKING STEEL BAR AND WIRE ROD PRODUCED BY CONTINUOUS CASTING

[75] Inventor: Kiyoaki Hisada, Tokyo, Japan

[73] Assignee: Nippon Steel Corporation, Tokyo, Japan

[22] Filed: Oct. 29, 1974

[21] Appl. No.: 518,986

Related U.S. Application Data

[63] Continuation of Ser. No. 342,711, March 19, 1973, abandoned, which is a continuation-in-part of Ser. No. 112,215, Feb. 3, 1971, abandoned.

[30] Foreign Application Priority Data

| | | |
|---|---|---|
| Feb. 23, 1970 | Japan | 45-15418 |
| Feb. 18, 1970 | Japan | 45-14035 |
| Mar. 30, 1970 | Japan | 45-26291 |
| Feb. 6, 1970 | Japan | 45-10522 |
| Feb. 19, 1970 | Japan | 45-14326 |

[52] U.S. Cl. ..... 75/58; 75/124; 164/76

[51] Int. Cl.[2] ..... C21C 7/06; C22C 38/06

[58] Field of Search ..... 75/58, 57, 124, 129; 164/76; 148/2

[56] References Cited

UNITED STATES PATENTS

| | | | |
|---|---|---|---|
| 3,000,731 | 9/1961 | Ototani | 75/129 |
| 3,020,153 | 2/1962 | Linz | 75/129 |
| 3,314,782 | 4/1967 | Arnaus | 75/57 |
| 3,411,957 | 11/1968 | Takai | 148/2 |
| 3,467,167 | 9/1969 | Mahin | 75/58 |
| 3,598,658 | 8/1971 | Matsukura | 148/2 |
| 3,711,277 | 1/1973 | Von Brogdandy | 75/57 |
| 3,754,895 | 8/1973 | Ramachandran | 75/59 |

*Primary Examiner*—Peter D. Rosenberg
*Attorney, Agent, or Firm*—Toren, McGeady and Stanger

[57] ABSTRACT

A method of producing steel bars and steel wire which can be cold worked is disclosed.

A steel furnace melt having a carbon content of between 0.01 to 0.25% is first deoxidized with manganese, aluminum and silicon in amounts so as to obtain a melt of the following composition:

0.01–0.25% of C
0.02–0.08% of Si
0.20–0.60% of Mn
0.002–0.015% of Al
less than 0.009% of S, and
between 50–150 ppm of oxygen, with the balance being iron.

The melt is then continuously cast and the cast product is rolled into bars or wires.

6 Claims, 1 Drawing Figure

COLD WORKING STEEL BAR AND WIRE ROD PRODUCED BY CONTINUOUS CASTING

CROSS-REFERENCE TO PRIOR APPLICATION

Figure 1:
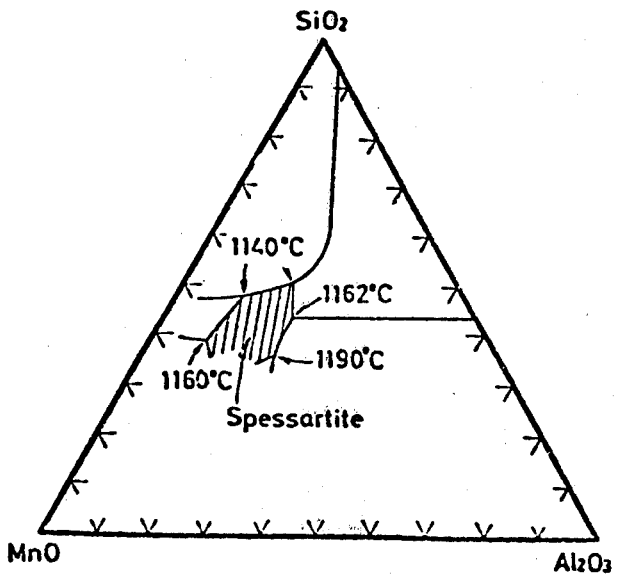

This is a continuation of application Ser. No. 342,711 filed Mar. 19, 1973, now abandoned, which in turn is a continuation-in-part application of application Ser. No. 112,215, filed Feb. 3, 1971, and also now abandoned.

FIELD OF INVENTION

The present invention relates to steel bars and wire rods which are produced by continuous casting and which can be cold worked.

BACKGROUND INFORMATION

Conventionally, cold-working steel bars and wire rods are mostly produced by cogging and rolling rimmed steel ingots. In some cases Al-killed or Al-Si-killed steel ingots are used for this purpose. All these steel ingots are produced by conventional ingot-making methods. It is, however, well known that better cold workability can be obtained with lower carbon contents, and in case of the same carbon content, rimmed steels are to be preferred over killed steels, while a lower sulfur content assures better workability. This means that the cold workability largely depends on the properties of the skin portion of the steel.

In continuous casting, however, when a rimmed steel is cast, a serious drawback resulting in an ultimate defect is that the generated gas remains near the surface portion of the cast billet or bloom, which produces blow-holes. Rolling of such billets or blooms results in considerably increased surface cracks. The problem of surface cracks due to blow-holes can be overcome by using killed steel which has been fully deoxidized with Al alone or with Al and Si, since the generation of gas within a mold can then be avoided. However, the presence of Al causes other problems instead in that a higher Al content in the melt tends to cause clogging of the tundish nozzle and forms alumina-inclusion which remains in both the surface and the core portions of the billet or bloom, thereby deteriorating severely the quality of products rolled therefrom.

On the other hand, a higher silicon content in the steel melt tends to embrittle the steel and lowers the workability to a significant extent.

Continuous casting has an advantage in that segregation is greatly reduced due to factors such as the cooling rate, as compared with an ordinary ingot-making process. Thus, non-uniform distribution of constituents through various portions of a cast ingot or bloom is negligible.

SUMMARY OF INVENTION

By putting this advantage to practical application, steel bars and wire rods having better cold workability than those obtained by an ordinary ingot-making process can be obtained.

Based upon the above knowledge, the present inventor has confirmed that casting can be effected with greatly reduced oxide inclusions and without CO gas generation by deoxidizing molten steel before it is subjected to continuous casting, so as to produce low melting point deoxidation products (Spessartite) of a ternary system of $MnO—SiO_2—Al_2O_3$ which easily combine and float up. Steel bars and wire rods having improved cold workability as compared to a rimmed steel produced by a conventional ordinary ingot-making process are thus obtained by using a cold-working steel composition produced by a novel process.

One of the features of the present invention resides in cold-working steel bars and wire rods produced by continuous casting and comprising 0.01 to 0.25% of carbon, 0.02 to 0.08% of silicon, 0.20 to 0.60% of manganese, 0.002 to 0.015% of aluminum and 50 to 150 ppm of oxygen. It is of particular importance that the oxygen content is within the indicated range since otherwise inferior results are obtained.

Accordingly, a primary feature of the present invention resides in cold-working steel bars and wire rods, free from blow-holes, and having a greatly reduced amount of non-metallic inclusions, which are produced by adding manganese, silicon, and aluminum as deoxidizer in metallic or alloy form to molten steel so as to obtain a steel composition containing less than 0.25% of carbon and 50 to 150 ppm of oxygen. The steel melt is preferably deoxidized so as to satisfy the following formula in the steel composition:

$$0.5 \leqq \frac{Mn\%/5}{Si\% + 10\ Al\%} \leqq 1.0 \qquad (1)$$

whereupon the steel melt is subjected to continuous casting.

The present invention will now be described in further detail.

Molten pig iron and scrap are melted and refined in any steel-making furnace such as a converter, an open hearth, and an electric furnace to obtain a steel containing less than 0.25% of carbon. The steel melt is then tapped into an ordinary ladle. In order to assure that the oxygen content in the steel will be 50–150 ppm, which is a critical feature of the present invention, Mn, Si and Al in combination are added as deoxidizer in metallic or alloy form.

The reasons for limiting the oxygen content to 50 to 150 ppm in the present invention are as follows:

In order to reduce the oxygen content to less than 50 ppm, it is necessary to deoxidize fully the melt with Al and Si. This, however, is undesired because the steel quality then deteriorates due to the alumina inclusions. This, in turn, reduces the cold workability significantly due to embrittlement caused by silicon.

On the other hand, if the oxygen content exceeds the upper limit of 150 ppm, CO gas is generated during casting which causes blow-holes, and thus remarkably increased surface cracks are obtained. Therefore, the oxygen content must be 50–150 ppm. The most preferred range for oxygen is from 80 to 120 ppm.

The relation between the oxygen content and the above formula (1) will now be explained with reference to the attached drawings which show a ternary constitutional diagram of $MnO—SO_2—Al_2O_3$.

In the ternary constitutional diagram, a compound (Spessartite) which has a low-melting point and remains liquid in the steel melt and is ready to coagulate and float up is formed, if the steel composition satisfies the equation (1), and thus non-metallic inclusions are greatly reduced. Even if the inclusions remain in the steel, they are easily turned into fine pieces by rolling and cold-working. Such pieces are not detrimental to the workability. The value (hereinafter expressed as $\alpha$) of the formula (1) of less than 0.5 is obtained by Al-Si-fully killed steels ($\alpha = 0.2–0.35$) in which the oxygen content is less than 50 ppm. In these steels, however, rigid inclusions, such as alumina clusters or colundum, precipitate to deteriorate the surface properties, and the silicon content embrittles the steel.

On the other hand, steels in which the value $\alpha$ exceeds 1.0, exhibit poor deoxidation and the oxygen content then exceeds 150 ppm. There is thus much increased tendency for blow-hole occurrence, and good surface qualities can no longer be expected with such steels if produced by continuous casting.

Only when the value $\alpha$ falls within the range of 0.5–1.0, steel billets or slabs produced by continuous casting are devoid of blow-holes and the problem of surface defects of rolled products is solved. At the same time, the inclusions are greatly reduced because complex deoxidation products of the hatched portion in FIG. 1 are formed, thus assuring great improvement in purity.

In case a steel melt which has a final oxygen content between 50–150 ppm is treated by a conventional ingot-making process, CO gas is generated during the solidification and needle and granular foams are produced near the surface skin in the upper portion of the ingot down to almost 50% height, which causes surface cracks. By contrast, in continuous casting, as proposed in the present invention, a constant static pressure, larger than the pressure for CO gas, is imposed on the steel melt, so that large foams which cause the surface cracks are not produced. Therefore, the casting of the steel melt of the above composition can be effected satisfactorily only by continuous casting.

The steel melt as controlled above is continuously cast, and the ingots thus obtained are made into bars or coils by known rolling processes. The thus obtained bars or coils contain hardly any inclusions and their cold workability is superior to that of the conventional cold-workable rimmed steel bars or coils.

Further, if desulfurized molten pig iron and low-sulfur steel scrap are melted and refined to render the sulfur content less than 0.009%, and the deoxidants, to wit, manganese, silicon and aluminum in metallic or alloy form, are added to the molten steel to obtain the indicated oxygen content, whereupon the molten steel is continuously cast, billets free from blow-holes and cold-working steel bars or wire rods containing very few sulfide inclusions and having excellent cold workability are obtained.

The reasons for the limitations of constituents other than oxygen will now be described.

If the carbon content in the steel is less than 0.01%, the mechanical strength of the steel bars and wire rod is poor. On the other hand, if the carbon content is above 0.25%, the workability is lowered. Therefore, in the present invention the carbon content is limited from 0.01 to 0.25%, and the most preferable range is from 0.03 to 0.2%.

If the silicon content is less than 0.02%, satisfactory deoxidation is not attained, the formed billets are susceptible to blow-holes, and rolled products therefrom exhibit many surface defects. Also, in order to form the low-melting point complex compound of the ternary system of $MnO—SiO_2—Al_2O_3$, more than 0.02% of silicon is required. On the other hand, however, if the silicon content is above 0.08%, silicate inclusions are formed which affect the purity of the steel and cause its embrittlement. This, of course, is undersirable in respect of cold workability.

Referring to the manganese content, a minimum amount of manganese is necessary in order to protect the steel from the negative influence of sulfur and to stimulate deoxidation. Manganese, however, hardens steel and negatively affects the mechanical properties of steel for cold working. The upper limit of the manganese content is thus naturally limited. If the manganese content is set to be 0.60% as an upper limit, steel can be imparted with better mechanical properties, as compared with those of an ordinary rimmed steel. The most preferred range for the manganese content is between 0.30 to 0.50%.

Regarding the aluminum content, more than 0.002% of aluminum is required, both for preventing blow-holes due to poor deoxidation and for forming the low-melting point compound of the ternary system of $MnO—SiO_2—Al_2O_3$. On the other hand, too much aluminum will cause clogging of the tundish nozzle, as is well known, and produces free alumina which remains in the skin portion and inner portion of the billet and greatly lowers its quality. Therefore, the aluminum content should not exceed 0.015%.

Regarding the sulfur content, a lower sulfur content gives less inclusions and better workability. Particularly, when the sulfur content is less than 0.009%, non-uniform distribution of sulfur in the billet or bloom is almost eliminated. This is due to the factors, such as the cooling rate inherent to continuous casting and the reduced degree of segregation. The cold workability of steel bars and wire rods produced from various portions of such billets or blooms is very excellent and stable.

An embodiment of the present invention shall be described hereinbelow.

Molten pig iron and scraps were melted and refined in a pure-oxygen converter according to ordinary operation standards, to obtain a composition containing less than 0.25% of carbon. The steel melt was then tapped into a ladle. During the tapping, Si—Mn, Fe—Mn, Fe—Si and Al were successively added to the molten steel to deoxidize the steel. Then the molten steel was subjected to a continuous casting.

Blooms produced by continuous casting, without further processing, were re-heated, rolled into billets and surface defects were treated with a magnetic flour detector (magnetic current: 800A). Analysis and surface processing of the billets of the present invention are shown in Table 1, in comparison with comparative rimmed steel billets obtained by an ordinary ingot-making procedure. As is clear from Table 1, the average ratio of the required surface processing of the billets according to the present invention is about 3%, while billets of comparative rimmed steel produced by an ordinary ingot-making process showed an average ratio of about 11%. Thus, it is demonstrated that the billets produced according to the present invention have much less surface defects.

The billets were then rolled into wires of 5.5 mm diameter by known rolling processes under the following rolling conditions:

| | |
|---|---|
| Temperature of billet taken out of a heating furnace | 1170° C |
| Finishing temperature | 980° C |
| Temperature at coiling | 750° C |

The absence of inclusions in the rolled wires was determined according to the spot calculation method of JIS (Japanese Industrial Standard). The results are shown in Table 1, which demonstrates that a remarkably improved cleanness from or absence of inclusions is obtained by the present procedure. As for cold-working properties, the limits of the upsetting rate were determined by subjecting wires of 5.5 mm diameter as rolled and acid pickled and having no surface defect, to a wire drawing of 20% into wires of 4.9 mm diameter which were subjected to an upsetting test. The results are shown in Table 1.

As described above, a remarkable reduction in the billet processing rate as well as in inclusions is attained by the present invention, as compared with the comparative steels, and better cold-working properties are obtained as compared with those obtained by rimmed steels of the ordinary ingot-making.

Table I

| | Test No | C (%) | Mn (%) | Si (%) | Al (%) | S (%) | O (ppm) | Ratio of Surface (%) Treated | Cleanness in wire rod ($d60 \times 400$ %) | $lu\,(\frac{D}{d})^2$ | |
|---|---|---|---|---|---|---|---|---|---|---|---|
| Inventive Steel | 1 | 0.02 | 0.50 | 0.05 | 0.005 | 0.020 | 150 | — | — | 2.9 | |
| | 2 | 0.04 | 0.47 | 0.06 | 0.004 | 0.017 | 120 | — | 0.03 | 2.8 | |
| | 3 | 0.05 | 0.37 | 0.05 | 0.004 | 0.020 | 110 | — | 0.04 | 2.8 | |
| | 4 | 0.08 | 0.44 | 0.08 | 0.003 | 0.019 | 113 | 3.2 | 0.04 | 2.6 | |
| | 5 | 0.10 | 0.42 | 0.07 | 0.008 | 0.013 | 90 | 2.9 | 0.02 | 2.5 | |
| | 6 | 0.13 | 0.49 | 0.03 | 0.007 | 0.015 | 95 | 2.7 | 0.02 | 2.4 | |
| | 7 | 0.17 | 0.48 | 0.06 | 0.006 | 0.016 | 90 | 3.1 | 0.02 | 2.2 | |
| | 8 | 0.19 | 0.50 | 0.05 | 0.009 | 0.017 | 83 | 3.3 | 0.04 | 2.2 | |
| | 9 | 0.22 | 0.37 | 0.03 | 0.010 | 0.018 | 70 | — | — | 2.1 | |
| | 10 | 0.25 | 0.51 | 0.08 | 0.006 | 0.018 | 61 | — | — | 2.0 | |
| | 11 | 0.08 | 0.40 | 0.05 | 0.006 | 0.008 | 120 | 3.2 | 0.02 | 2.8 | low-sulfur grades |
| | 12 | 0.17 | 0.35 | 0.06 | 0.007 | 0.005 | 95 | 2.0 | 0.01 | 2.5 | |
| | 13 | 0.24 | 0.51 | 0.06 | 0.014 | 0.004 | 50 | 2.7 | 0.01 | 2.2 | |
| Comparative Steel | 14 | 0.07 | 0.35 | 0.01 | <0.001 | 0.019 | 280 | 10.5 | 0.13 | 2.4 | |
| | 15 | 0.12 | 0.37 | 0.01 | <0.001 | 0.020 | 250 | 12.3 | 0.10 | 2.1 | |
| | 16 | 0.20 | 0.40 | 0.01 | <0.001 | 0.015 | 172 | 13.7 | 0.11 | 1.9 | |
| | 17 | 0.09 | 0.38 | 0.01 | <0.001 | 0.007 | 253 | 9.3 | 0.07 | 2.4 | |
| | 18 | 0.15 | 0.42 | 0.01 | <0.001 | 0.005 | 215 | 10.1 | 0.06 | 2.3 | |

What is claimed is:

1. A method of producing steel bars and steel wire which can be cold worked, consisting essentially of:

a. deoxidizing a steel furnace melt having a carbon content of between 0.01 to 0.25% with manganese, aluminum and silicon in amounts so as to obtain a melt consisting essentially of
0.01–0.25% of C
0.02–0.08% of Si
0.20–0.60% of Mn
0.002–0.015% of Al
less than 0.009% of S and
between 50–150 ppm of oxygen, with the balance being iron, b. casting the melt continuously and c. rolling the cast product into bars or wires.

2. A method as claimed in claim 1, wherein step (a) is carried out while the melt is tapped from the melt producing furnace into a ladle.

3. A method as claimed in claim 1, wherein said steel furnace melt has a carbon content of 0.03–0.20% and the amount of manganese, silicon and aluminum is such that the deoxidized melt composition consists essentially of C: 0.03–0.20%
Mn: 0.30–0.50%
Si: 0.02–0.08%
Al: 0.002–0.15%
Oxygen: 80–120 ppm with the balance being iron.

4. A method as claimed in claim 1, wherein the amounts of manganese, silicon, and aluminum added satisfy the formula:

$$0.5 \leqq \frac{Mn\%/5}{Si\% + 10\ Al\%} \leqq 1.0$$

5. A steel bar or wire produced by the method of claim 1.

6. A steel bar or wire produced by the method of claim 3.

* * * * *